US009643756B2

(12) United States Patent
Tanaike et al.

(10) Patent No.: US 9,643,756 B2
(45) Date of Patent: May 9, 2017

(54) STORAGE BAG AND PAPER SHEET STORING DEVICE

(71) Applicant: GLORY LTD., Himeji-shi, Hyogo (JP)

(72) Inventors: Takashi Tanaike, Himeji (JP); Takayuki Kishibuchi, Himeji (JP)

(73) Assignee: GLORY LTD., Himeji-shi, Hyogo (JP)

( * ) Notice: Subject to any disclaimer, the term of this patent is extended or adjusted under 35 U.S.C. 154(b) by 0 days.

(21) Appl. No.: 14/197,272

(22) Filed: Mar. 5, 2014

(65) Prior Publication Data

US 2014/0254960 A1 Sep. 11, 2014

(30) Foreign Application Priority Data

Mar. 6, 2013 (JP) ..... 2013-043673

(51) Int. Cl.

| | |
|---|---|
| ***B65D 33/00*** | (2006.01) |
| ***B65D 33/16*** | (2006.01) |
| ***B65D 33/14*** | (2006.01) |
| ***B65D 33/20*** | (2006.01) |
| ***G07F 19/00*** | (2006.01) |
| ***G07D 11/00*** | (2006.01) |

(52) U.S. Cl.

CPC ..... *B65D 33/1691* (2013.01); *B65D 33/14* (2013.01); *B65D 33/20* (2013.01); *G07D 11/0006* (2013.01); *G07D 11/009* (2013.01); *G07F 19/201* (2013.01)

(58) Field of Classification Search

CPC ..... B65D 33/02; B65D 33/08; B65D 33/243; B65D 33/265; B65D 33/20; B65D 75/5838; B65D 75/5855; B65D 33/14; B65D 33/1691; G07F 19/201; G07D 11/009; G07D 11/0006

USPC ..... 383/210, 211, 9, 12

See application file for complete search history.

(56) References Cited

U.S. PATENT DOCUMENTS

| | | | | |
|---|---|---|---|---|
| 2,113,089 | A * | 4/1938 | Klahn | 383/5 |
| 2,205,529 | A * | 6/1940 | Heywood | B65D 27/16 229/80 |
| 2,513,040 | A * | 6/1950 | Miller | 383/6 |
| 2,601,946 | A * | 7/1952 | Heywood | B65D 27/16 229/80 |

(Continued)

FOREIGN PATENT DOCUMENTS

| | | |
|---|---|---|
| CH | 598 069 A5 | 4/1978 |
| DE | 93 02 138 U1 | 5/1993 |
| FR | 2 853 301 A1 | 10/2004 |

OTHER PUBLICATIONS

European Search Report (Application No. 14157918.5) (6 pages—dated Jun. 23, 2014).

(Continued)

*Primary Examiner* — Peter Helvey

(74) *Attorney, Agent, or Firm* — Renner, Kenner, Greive, Bobak, Taylor & Weber

(57) ABSTRACT

A storage bag includes a body having a top opening, a first fitting portion and a second fitting portion disposed in the vicinity of the opening of the body, an adhesive portion disposed on an inner surface of the body in the vicinity of the first fitting portion, the adhesive portion being configured to seal the body, and a release sheet detachably adhering to the adhesive portion, the release sheet protecting the adhesive portion, and the release sheet covers at least one of the first fitting portion and the second fitting portion.

15 Claims, 9 Drawing Sheets

(56) References Cited

U.S. PATENT DOCUMENTS

| | | | | |
|---|---|---|---|---|
| 3,095,578 | A * | 7/1963 | Stanford | A61F 5/44 248/99 |
| 4,175,604 | A * | 11/1979 | Bonner | 383/5 |
| 4,709,397 | A * | 11/1987 | Voshall et al. | 383/5 |
| 5,645,353 | A * | 7/1997 | Linnell et al. | 383/22 |
| 5,788,377 | A * | 8/1998 | Vetter | B65D 27/30 383/107 |
| 7,033,077 | B2 * | 4/2006 | Taylor | B31B 19/90 383/62 |
| 7,318,548 | B2 * | 1/2008 | Felice et al. | 232/45 |
| 8,157,443 | B2 * | 4/2012 | Khan | 378/184 |
| 2004/0013322 | A1 * | 1/2004 | Taylor | B31B 19/90 383/62 |
| 2004/0139693 | A1 * | 7/2004 | Lamers | 53/67 |
| 2007/0210171 | A1 * | 9/2007 | Spitz | 235/486 |
| 2010/0189379 | A1 * | 7/2010 | Razzaboni et al. | 383/33 |
| 2012/0042610 | A1 * | 2/2012 | Giovanetto et al. | 53/266.1 |
| 2013/0138242 | A1 * | 5/2013 | Kallin | 700/230 |

OTHER PUBLICATIONS

European Office Action (Application No. 14 157 918.5) (4 pages—dated May 22, 2015).

* cited by examiner

STORAGE BAG AND PAPER SHEET STORING DEVICE

CROSS REFERENCE TO THE RELATED APPLICATION

This application is based upon and claims the benefit of priority from the prior Japanese Patent Application No. 2013-043673 filed on Mar. 6, 2013, the entire contents of which are incorporated herein by reference.

FIELD OF THE INVENTION

The present invention relates to a storage bag storing paper sheets such as banknotes, and a paper sheet storing device including a storing unit to which such a storage bag is detachably attached.

BACKGROUND ART

Some conventional paper sheet storing devices for storing paper sheets such as banknotes, each collect the introduced paper sheets into a storage bag such as a pouch. Such a storage bag is disclosed in French Patent Publication No. FR2853301A2, for example. The storage bag disclosed in French Patent Publication No. FR2853301A2 includes, for example, a pair of plastic tabs for the attachment of the storage bag into the paper sheet storing device, on the outer surfaces of the bag body in the vicinity of the top opening thereof. In specific, the tabs each include ears protruding upward from the edge of the top opening of the bag body and each including a through hole for fixation. Pins provided to the paper sheet storing device are inserted through the corresponding through holes of the ears, so that the storage bag is detachably attached to the paper sheet storing device. The body of the storage bag includes a narrow adhesive portion for sealing the body that horizontally extends on one of the inner surfaces in the vicinity of the top opening. A release sheet adheres to the adhesive portion to protect the adhesive portion.

SUMMARY OF INVENTION

In a paper sheet storing device using the storage bag disclosed in French Patent Publication No. FR2853301A2, an operator removes the release sheet from the adhesive portion on the inner surface of the bag body to expose the adhesive portion upon the attachment of the storage bag to the paper sheet storing device. Upon the detachment of the storage bag from the paper sheet storing device for the collection of the storage bag after the storage of paper sheets into the storage bag, the exposed adhesive portion adheres to the opposite inner surface of the bag body to seal the storage bag. Unfortunately, the conventional storage bag disclosed in French Patent Publication No. FR2853301A2 is problematic since the operator may forget to remove the release sheet from the adhesive portion upon the attachment of the storage bag to the paper sheet storing device. The release sheet remaining at the adhesive portion leads to the unsealed storage bag upon the detachment.

An object of the present invention, which has been accomplished to solve the above problem, is to provide a storage bag and a paper sheet storing device that remind an operator of removal of the release sheet from the adhesive portion upon the attachment of the storage bag to the paper sheet storing device, and thus can prevent the operator from forgetting to remove the release sheet.

The present invention is a storage bag including a body having a top opening; a first fitting portion and a second fitting portion disposed in the vicinity of the opening of the body; an adhesive portion disposed on an inner surface of the body in the vicinity of the first fitting portion, the adhesive portion being configured to seal the body; and a release sheet detachably adhering to the adhesive portion, the release sheet protecting the adhesive portion, and the release sheet covers at least one of the first fitting portion and the second fitting portion.

In the storage bag of the present invention, the release sheet may also detachably adhere to another inner surface of the body in the vicinity of the second fitting portion.

In the storage bag of the present invention, the first fitting portion and the second fitting portion may each include fixing ears protruding upward from the edge of the opening of the body.

In the storage bag of the present invention, the first fitting portion and the second fitting portion may each include through holes for fixation of the storage bag.

In the storage bag of the present invention, the release sheet may have a bent portion to define a handgrip for an operator.

In the storage bag of the present invention, the release sheet may have a color different from the color of the body.

In the storage bag of the present invention, the release sheet may include an opaque material.

In the storage bag of the present invention, the release sheet may have a message described thereon to promote the operator to remove the release sheet.

The present invention is a storage bag including a body having a top opening; a fitting portion disposed in the vicinity of the opening of the body; an adhesive portion disposed on an inner surface of the body in the vicinity of the opening, the adhesive portion being configured to seal the body; and a release sheet detachably adhering to the adhesive portion, the release sheet protecting the adhesive portion, and the release sheet covers the fitting portion.

In the storage bag of the present invention, the fitting portion may include a fixing ear protruding upward from the edge of the opening of the body.

In the storage bag of the present invention, the fitting portion may include a through hole for fixation of the storage bag.

In the storage bag of the present invention, the release sheet may have a bent portion to define a handgrip for an operator.

In the storage bag of the present invention, the release sheet may have a color different from the color of the body.

In the storage bag of the present invention, the release sheet may include an opaque material.

In the storage bag of the present invention, the release sheet may have a message described thereon to promote the operator to remove the release sheet.

The present invention is a paper sheet storing device including a storing unit to which a storage bag is detachably attached, the storage bag including a body having a top opening, an adhesive portion disposed on an inner surface of the body in the vicinity of the opening, the adhesive portion being configured to seal the body, and a release sheet detachably adhering to the adhesive portion, the release sheet protecting the adhesive portion, and a release sheet detector to detect the release sheet remaining on the storage bag attached to the storing unit is provided to the storing unit.

The paper sheet storing device of the present invention may further include a notifier to notify an operator of the detection of the release sheet remaining on the storage bag attached to the storing unit if the release sheet detector detects the remaining release sheet.

DETAILED DESCRIPTION OF THE INVENTION

A banknote teller device for handling banknotes that serves as a paper sheet storing device according to an embodiment of the present invention will now be described. A cash teller machine including the combination of a banknote teller device and a coin teller device according to this embodiment will also be described.

Figure 1:
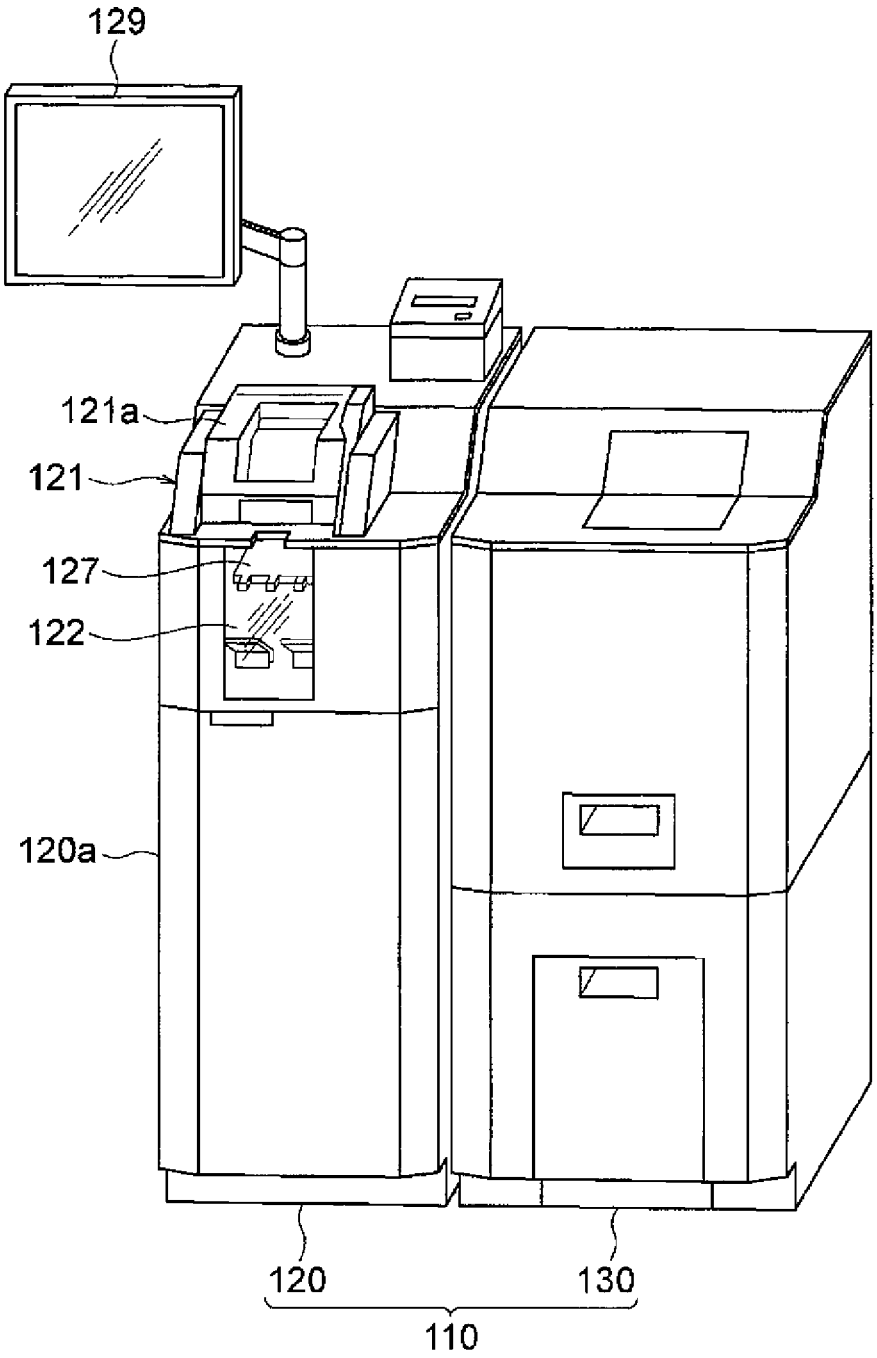
FIG. 1 is a perspective view illustrating the appearance of a cash teller machine according to an embodiment of the present invention.
Figure 2:
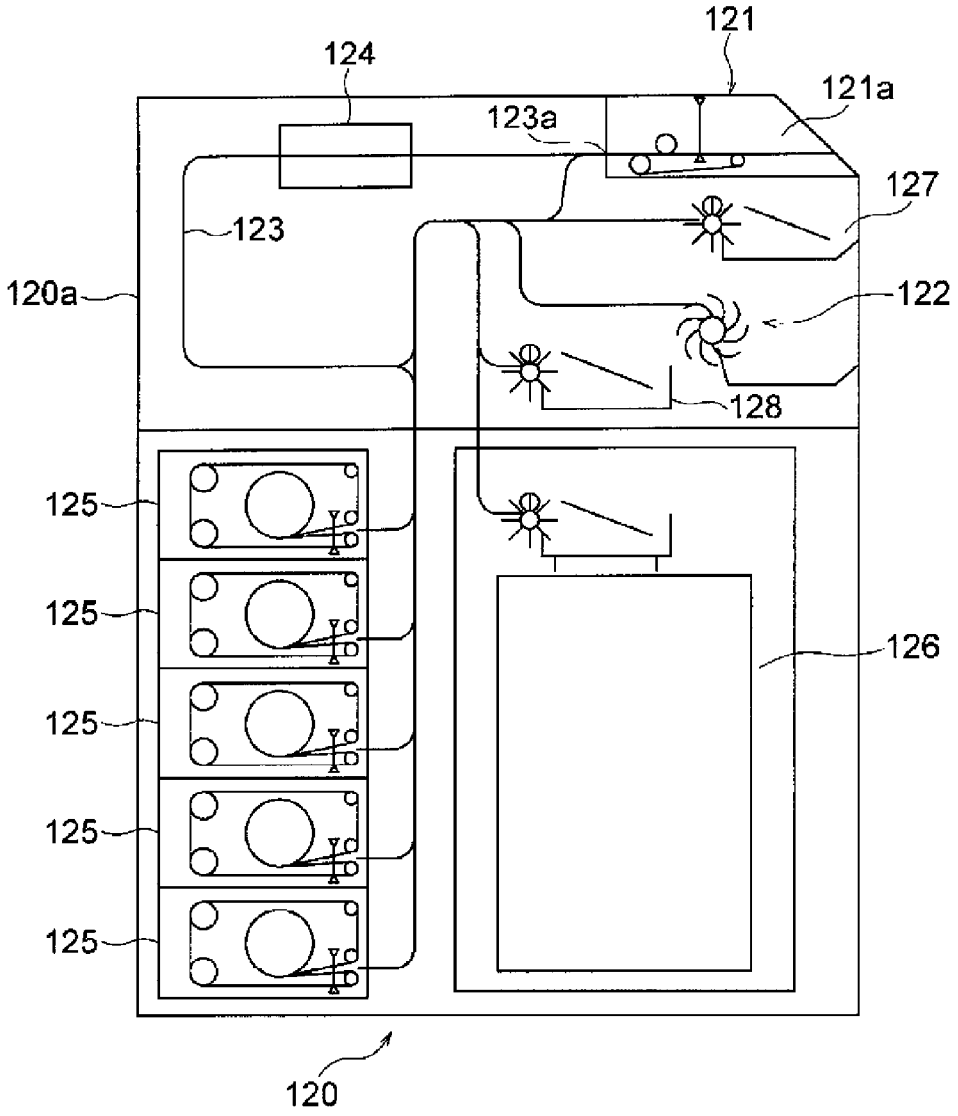
FIG. 2 is a schematic diagram illustrating the internal structure of a banknote teller device of the cash teller machine in FIG. 1.
Figure 3:
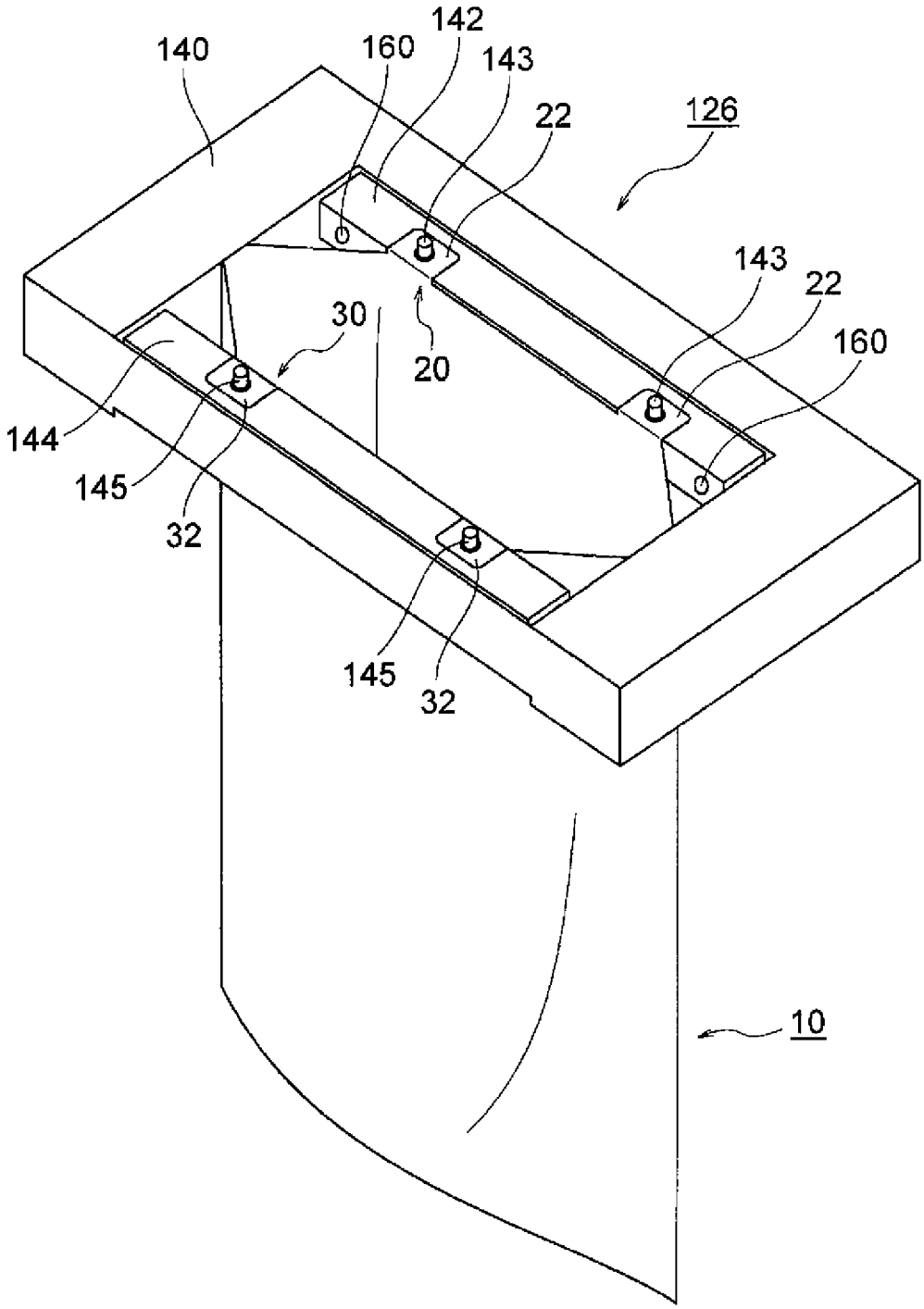
FIG. 3 is a perspective view of a storage bag attached to a storing unit of the banknote teller device in FIG. 2 and a storage bag holder for holding the storage bag.

FIGS. 1 to 12 illustrate a storage bag and a banknote teller device including a storing unit in which the storage bag is detachably attached according to this embodiment: FIG. 1 is a perspective view illustrating the appearance of a cash teller machine according to this embodiment; FIG. 2 is a schematic diagram illustrating the internal structure of the banknote teller device of the cash teller machine in FIG. 1; FIG. 3 is a perspective view of a storage bag attached to the storing unit of the banknote teller device in FIG. 2 and the storage bag holder for holding the storage bag; and FIGS. 4 to 12 each illustrate the specific structure of the storage bag.

The structure of a cash teller machine 110 will now be described with reference to FIG. 1. In general, a store such as a supermarket consists of a front area, in which clerks deposit and withdraw cash for actual transactions with customers, and a backyard area for management of the cash and merchandise in the front area. The front area includes one or more cash checkout machines, while the backyard area includes the cash teller machine 110 as illustrated in FIG. 1. The cash checkout machines are each operated by a clerk to execute a checkout process between the clerk and customers. For example, the cash checkout machines each receive a payment by a customer and discharge change to be given to a customer. The cash teller machine 110 discharges change funds to be charged in the cash checkout machines and receives the sales proceeds collected from the cash checkout machines. The cash teller machine 110 exchanges cash with the cash checkout machines by means of a cash carrier cassette, which can be attached to or detached from the cash teller machine 110 and the cash checkout machines. Separated from the cash teller machine 110 and the cash checkout machines, the cash carrier cassette inhibits the cash therein from exiting.

With reference to FIG. 1, the cash teller machine 110 provided in the backyard area includes a banknote teller device 120 and a coin teller device 130. The banknote teller device 120 discharges banknotes to be charged in the cash checkout machines provided in the front area and receives banknotes collected from the cash checkout machines. The coin teller device 130 discharges coins to be charged in the cash checkout machines provided in the front area and receives coins collected from the cash checkout machines.

The structure of the banknote teller device 120 will now be described in brief with reference to FIGS. 1 and 2. With reference to FIG. 1, the banknote teller device 120 includes a housing 120*a*, an inlet 121, an outlet 122, and an operation/display unit 129. A banknote receiving unit 121*a* is detachably attached to the inlet 121. The banknote receiving unit 121*a* receives banknotes introduced into the banknote teller device 120, and feeds the banknotes one by one into the housing 120*a*. The banknote receiving unit 121*a* is used when a clerk manually deposits banknotes into the banknote teller device 120. The inlet 121 may be provided with the cash carrier cassette instead of the banknote receiving unit 121*a*. In this case, the cash carrier cassette attached to the inlet 121 causes a feeder inside the cash carrier cassette to feed the banknotes therein one by one into the housing 120*a*.

With reference to FIG. 2, the housing 120*a* of the banknote teller device 120 includes a transport unit 123 therein for transporting the banknotes one by one, which has an end 123*a* connected to the inlet 121. The transport unit 123 transports the banknotes fed from the banknote receiving unit 121*a* attached to the inlet 121 through the end 123*a* of the transport unit 123.

The transport unit 123 is provided with a recognition unit 124, which recognizes the properties, such as denomination, fitness, and authenticity of the banknotes transported by the transport unit 123, as illustrated in FIG. 2.

The housing 120*a* includes storing/feeding units 125 each connected with the transport unit 123. The storing/feeding units 125 store banknotes of different denominations. In specific, the banknotes fed from the inlet 121 into the transport unit 123 are transported by the transport unit 123 into the individual storing/feeding units 125 corresponding to the denominations on the basis of the results of recognition by the recognition unit 124. The storing/feeding unit 125 can feed the banknotes stored therein one by one into the transport unit 123. The storing/feeding unit 125 may be provided with a tape reel to hold the banknotes one by one between a pair of tapes and to reel the banknotes in the tapes, as illustrated in FIG. 2, or may be provided with a stacker (not shown) to store the stacked banknotes.

The housing 120*a* further includes a storing unit (collection unit) 126, which is used upon the collection of the banknotes stored in the storing/feeding units 125. In more specific, the banknotes transported from the storing/feeding units 125 through the transport unit 123 into the storing unit 126 are collected into a storage bag 10 (described below) for storing banknotes, which is detachably attached to the storing unit 126. The storage bag 10 also stores banknotes of denominations that are not assigned to any of the storing/feeding units 125 and overflow banknotes that are assigned to the storing/feeding unit 125 filled with the banknotes. The detachment of the storage bag 10 from the storing unit 126 leads to the collection of the banknotes in the storage bag 10 from the banknote teller device 120 in such a manner that the storage bag itself is collected.

With reference to FIG. 2, the banknote teller device 120 includes an external reject unit 127 and an internal reject unit 128. The external reject unit 127 is supplied with rejected banknotes from the transport unit 123, which are recognized to be abnormal by the recognition unit 124 among the banknotes introduced through the inlet 121 into the housing 120*a*. The external reject unit 127 discharges the rejected banknotes from the banknote teller device 120. The internal reject unit 128 is supplied with the rejected banknotes that should not exit the banknote teller device 120 from the transport unit 123, and stores the rejected banknotes. The internal reject unit 128 inhibits the banknotes therein from being extracted by any unauthorized operator such as a clerk.

The operation/display unit 129 displays various types of informative items, such as the storage states of banknotes and coins in the cash teller machine 110, and receives the data input by a clerk. The operation/display unit 129 includes a touch panel display, for example. The operation/display unit 129 is provided to either the banknote teller device 120 or the coin teller device 130 and is shared by these devices to display their informative items.

Figure 4:
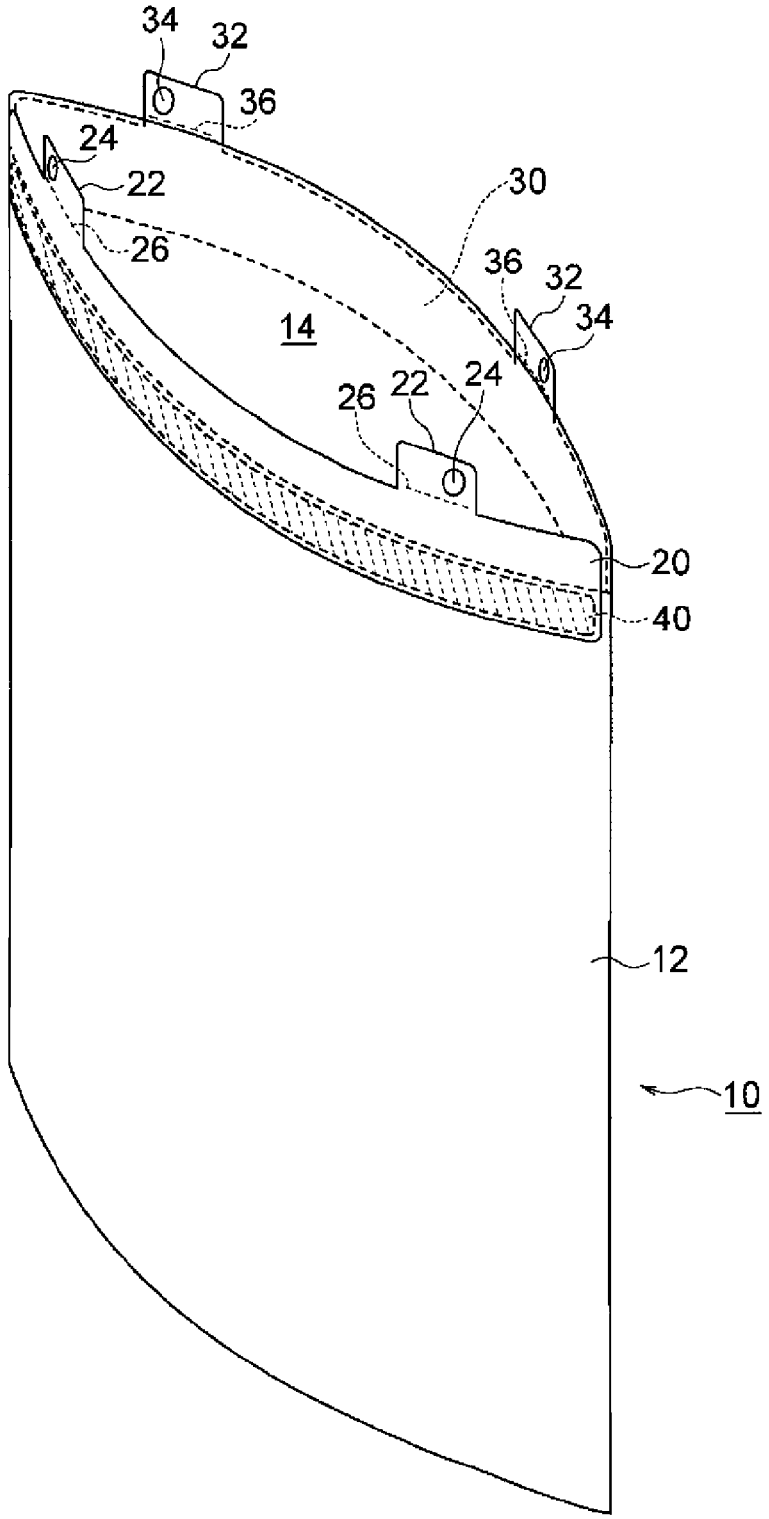
FIG. 4 is a perspective view of a storage bag after removal of a release sheet.
Figure 5:
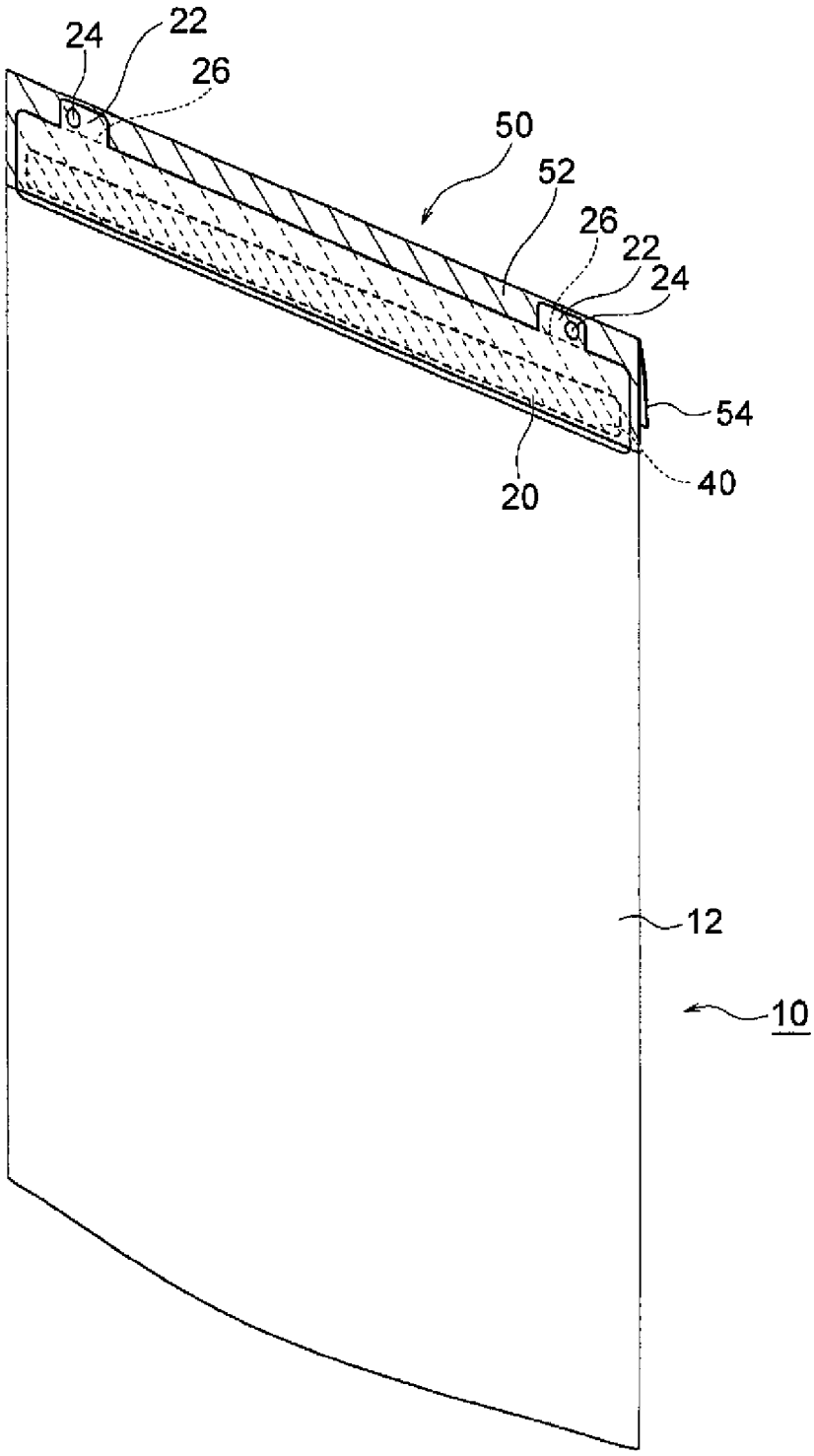
FIG. 5 is a perspective view of a storage bag before removal of a release sheet.
Figure 6:
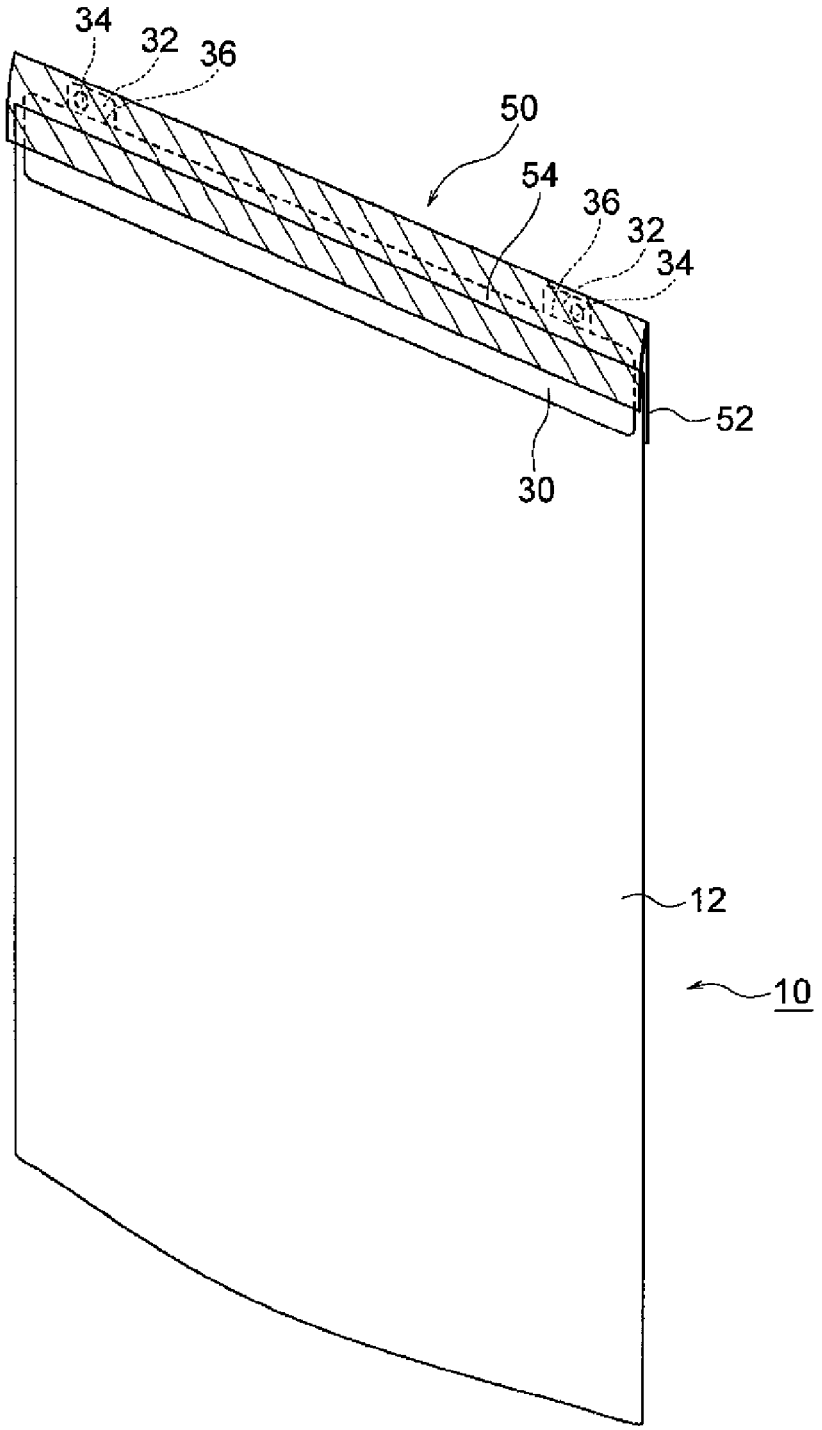
FIG. 6 is a rear perspective view of the storage bag in FIG. 5.
Figure 7:
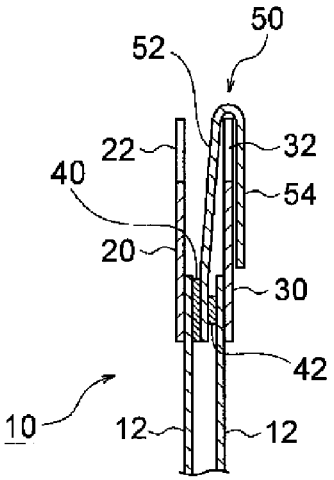
FIG. 7 is a longitudinal sectional view of a storage bag before removal of a release sheet.
Figure 8:
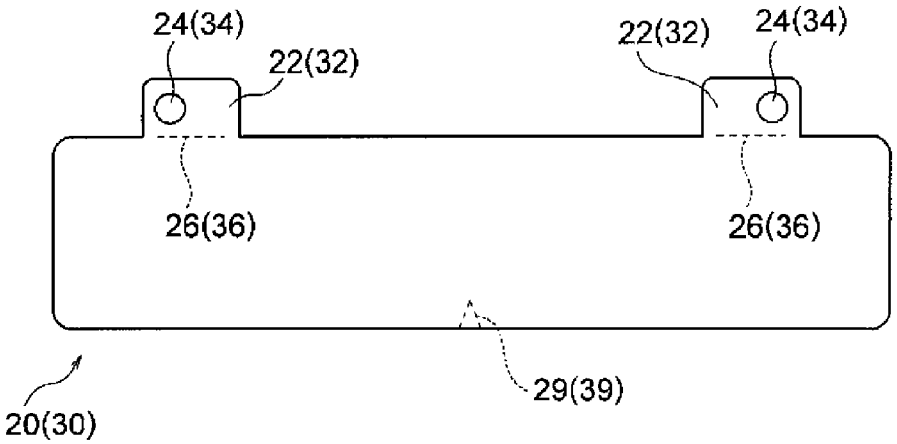
FIG. 8 illustrates a fixation tab provided to a storage bag.
Figure 9:
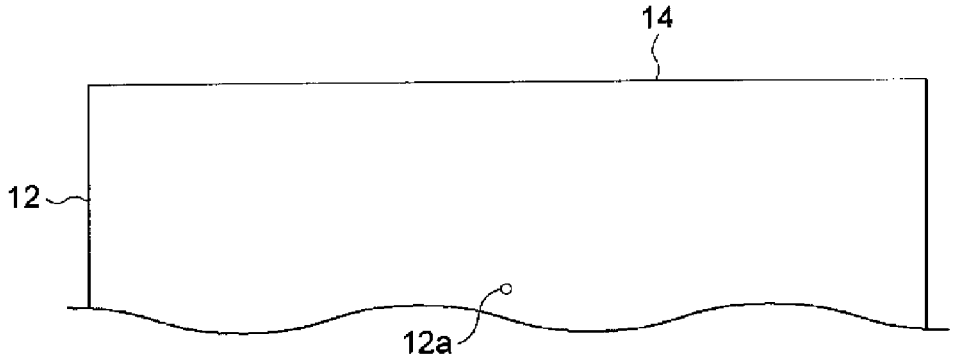
FIG. 9 illustrates the upper body of a storage bag.
Figure 10:
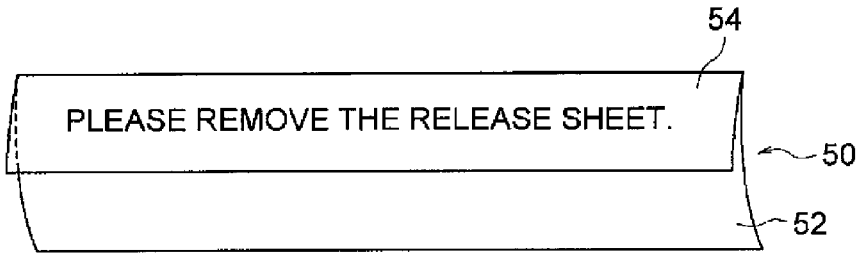
FIG. 10 illustrates a release sheet.

The structures of the storing unit 126 of the banknote teller device 120 and the storage bag 10 attached to the storing unit 126 will now be described with reference to FIGS. 3 to 10. FIG. 3 is a perspective view of the storage bag 10 attached to the storing unit 126 of the banknote teller device 120 in FIG. 2, and a storage bag holder 140 for holding the storage bag 10. FIG. 4 is a perspective view of the storage bag 10 after removal of a release sheet 50. FIG. 5 is a perspective view of the storage bag 10 before removal of the release sheet 50. FIG. 6 is a rear perspective view of the storage bag 10 in FIG. 5. FIG. 7 is a longitudinal sectional view of the storage bag 10 before removal of the release sheet 50. FIG. 8 illustrates a fixation tab 20 or 30 provided on the storage bag 10. FIG. 9 illustrates the upper body 12 of the storage bag 10. FIG. 10 illustrates the release sheet 50.

The storage bag holder 140, which is provided in the storing unit 126 of the banknote teller device 120, includes a first holder 142 and a second holder 144 spaced apart from and opposed to each other, as illustrated in FIG. 3. The second holder 144 has a fixed position whereas the first holder 142 is movable toward the second holder 144. While banknotes, which are transported from the storing/feeding units 125 through the transport unit 123 into the storing unit 126 in the banknote teller device 120, are being stored into the storage bag 10 attached to the storing unit 126, the first holder 142 and the second holder 144 are spaced apart from each other, as illustrated in FIG. 3. Upon detachment of the storage bag 10 from the storing unit 126 after the storage of the banknotes into the storage bag 10, the first holder 142 moves toward the second holder 144 (in specific, the first holder 142 moves toward the lower left in FIG. 3) to come into contact with the second holder 144, so that an adhesive portion 40 (described below) on the inner surface of the body 12 of the storage bag 10 seals the body 12.

As illustrated in FIGS. 4 to 6, the storage bag 10 according to this embodiment includes the body 12 having an opening 14 at the top. The first fixation tab 20 is provided on one of the outer surfaces of the body 12 in the vicinity of the opening 14, whereas the second fixation tab 30 is provided on the other outer surface (other than the outer surface provided with the first fixation tab 20) in the vicinity of the opening 14. As illustrated in FIGS. 4 to 7, the narrow adhesive portion 40 for sealing the body 12 horizontally extends (i.e., in the width direction of the storage bag 10) on the inner surface of the body 12 in the vicinity of the first fixation tab 20. The release sheet 50 detachably adheres to the adhesive portion 40 to protect the adhesive portion 40. In this embodiment, the release sheet 50 covers the second fixation tab 30 as illustrated in FIGS. 6 and 7. The structure of the storage bag 10 will now be described in detail.

As illustrated in the drawings such as FIGS. 4 to 6 and 8, the first fixation tab 20 includes two ears 22 protruding upward from the edge of the opening 14 of the body 12 and each having a through hole 24 for fixation. Each of the ears 22 has perforations 26 that allow the ear 22 to be bent therealong. The second fixation tab 30 also includes two ears 32 protruding upward from the edge of the opening 14 of the body 12 and each having a through hole 34 for fixation. Each of the ears 32 has perforations 36 that allow the ear 32 to be bent therealong. The first fixation tab 20 and the second fixation tab 30 are each made of a transparent plastic, for example. The perforations 26 or 36 extend in a part rather than the entirety of the fixing portion of each ear 22 or 32, as illustrated in FIG. 8. This structure can prevent the ears 22 and 32 from being torn out of the fixation tabs 20 and 30 along the perforations 26 and 36 by the action of the weight of banknotes stored in the storage bag 10 attached to the storing unit 126 of the banknote teller device 120.

With reference to FIG. 3, the first holder 142 and the second holder 144 of the storage bag holder 140 each include a pair of pins 143 or 145. To attach the storage bag 10 to the storing unit 126 of the banknote teller device 120, an operator bends the ears 22 and 32 along the perforations 26 and 36 in the fixation tabs 20 and 30, and places the bent ears 22 and 32 such that the pins 143 and 145 stick through the through holes 24 and 34, respectively. Thus, the storage bag 10 is opened and held with the first holder 142 and the second holder 144 of the storage bag holder 140, as illustrated in FIG. 3.

The structure of the release sheet 50 adhering to the adhesive portion 40 for sealing the body 12 will now be described. With reference to FIGS. 5 and 6, the release sheet 50 adhering to the adhesive portion 40 prevents the adhesive portion 40 from being exposed before the attachment of the storage bag 10 to the storing unit 126 of the banknote teller device 120. Upon the attachment of the storage bag 10 to the storing unit 126 of the banknote teller device 120 as illustrated in FIG. 3, an operator removes the release sheet 50 from the adhesive portion 40 to expose the adhesive portion 40. To detach the storage bag 10 from the storing unit 126 of the banknote teller device 120 after the completion of the storage of the banknotes into the storage bag 10, the first holder 142 moves toward the second holder 144 to come into contact therewith in the storage bag holder 140, so that the adhesive portion 40 seals the body 12.

With reference to the drawings such as FIGS. 5 to 7 and 10, the release sheet 50 consists of a first sheet segment 52 adhering to the adhesive portion 40 and a second sheet segment 54 adjoining the first sheet segment 52 via the fold. The second sheet segment 54 folded over the first sheet segment 52 adhering to the adhesive portion 40 serves as a handgrip for an operator to remove the release sheet 50 from the adhesive portion 40. With reference to FIGS. 6 and 7, the first sheet segment 52 and the second sheet segment 54 of the release sheet 50 cover the second fixation tab 30, in particular, the ears 32 of the second fixation tab 30. This structure reminds the operator of the release sheet 50 when the ears 32 of the second fixation tab 30 are placed such that the pins 145 of the second holder 144 stick through the though holes 34, and prompts the operator to remove the release sheet 50 surely from the adhesive portion 40, upon the attachment of the storage bag 10 to the storing unit 126 of the banknote teller device 120 as illustrated in FIG. 3. In other words, the release sheet 50 must be removed to expose the through holes 34 of the ears 32 of the second fixation tab 30; hence, the pins 145 of the second holder 144 cannot stick through the through holes 34 without the removal of the release sheet 50. Thus, the release sheet 50 covering the second fixation tab 30 reminds the operator of removal of the release sheet 50 from the adhesive portion 40 upon the attachment of the storage bag 10 to the storing unit 126 of the banknote teller device 120, preventing the operator from forgetting to remove the release sheet 50.

In this embodiment, the release sheet 50 has a color different from that of the body 12. In a specific example, the body 12 is colorless and transparent while the release sheet 50 is red. This feature highlights the release sheet 50, and thus prompts the operator to remove the release sheet 50 surely from the adhesive portion 40 upon the attachment of the storage bag 10 to the storing unit 126 of the banknote teller device 120. The body 12 is not always limited to colorless and transparent, and may have any clear or light-transmissive color. If the storing unit 126 of the banknote teller device 120 does not include release sheet detecting sensors 160 (described below), the body 12 may contain an opaque material.

The release sheet 50 preferably contains an opaque material. This feature causes the release sheet 50 to hide the ears 32 of the second fixation tab 30, and thus prompts the operator to remove the release sheet 50 surely from the adhesive portion 40 upon the attachment of the storage bag 10 to the storing unit 126 of the banknote teller device 120.

With reference to FIG. 10, the second sheet segment 54 of the release sheet 50 has a message described thereon that promotes the operator to remove the release sheet 50, such as "Please remove the release sheet." This feature prompts the operator to remove the release sheet 50 surely from the adhesive portion 40 upon the attachment of the storage bag 10 to the storing unit 126 of the banknote teller device 120.

In this embodiment, whereas one of the surfaces of the first sheet segment 52 of the release sheet 50 adheres to the adhesive portion 40, the other surface (on the right in FIG. 7) detachably adheres to the inner surface of the body 12 in the vicinity of the second fixation tab 30 at an additional adhesive portion 42, as illustrated in FIG. 7. While the adhesive portion 40 is narrow and horizontally extends in the width direction of the opening 14 of the body 12, the additional adhesive portion 42 has an extremely-small dot shape and bonds the first sheet segment 52 of the release sheet 50 to the inner surface of the body 12 via the extremely-small adhesion area. This structure enables the operator to notice the adhesion between the first sheet segment 52 of the release sheet 50 and the inner surface of the body 12 in the vicinity of the second fixation tab 30 and to notice the release sheet 50, upon the opening of the storage bag 10 to be attached to the storing unit 126 of the banknote teller device 120, and thus prompts the operator to remove the release sheet 50 surely from the adhesive portion 40.

In this embodiment, the body 12 of the storage bag 10 includes an air vent hole (not shown). In general, the body 12 of the storage bag 10 sealed at the adhesive portion 40 contains not only banknotes but air therein; hence the storage bag 10 with a large volume may occupy much space and cause other problems during the transportation. The air vent hole in the body 12 of the storage bag 10 removes the air from the sealed body 12 and thus can reduce the volume of the storage bag 10.

With reference to FIG. 8, the fixation tabs 20 and 30 include their respective central triangle marks 29 and 39 at their lower edges. With reference to FIG. 9, the front and rear surfaces of the body 12 each include a small hole 12*a* with a diameter of about 0.5 mm at the upper part in the vicinity of the opening 14. Each of the holes 12*a* at the both surfaces of the body 12 is aligned to the bottom center of each central triangle mark 29 or 39 at the lower edge of the fixation tab 20 or 30, so that each fixation tab 20 or 30 can be attached at a desired position in the body 12. The holes 12*a* at the both surfaces of the body 12 may also serve as the air vent hole. In addition to or instead of the central triangle mark 29 or 39 at the lower edge of the fixation tab 20 or 30, a center line (not shown) vertically extending in FIG. 8 may be provided along the width-wise center of each fixation tab 20 or 30. In this case, each of the holes 12*a* at the both surfaces of the body 12 is aligned to each center line in the fixation tab 20 or 30, so that each fixation tab 20 or 30 can be attached at a desired position in the body 12.

With reference to FIG. 3, the storing unit 126 of the banknote teller device 120 includes the release sheet detecting sensors 160 for detecting the release sheet 50 remaining on the storage bag 10 held with the storage bag holder 140. The release sheet detecting sensors 160 consist of optical sensors each including a light-emitting device provided to the first holder 142 and a photoreceptor provided to the second holder 144, for example. The release sheet 50 made of an opaque material cuts off the light emitted from the light-emitting devices to the photoreceptors, so that the release sheet detecting sensors 160 detect the release sheet 50 remaining on the storage bag 10. Thus, the release sheet detecting sensors 160 can detect the remaining release sheet 50 if an operator attaches the storage bag 10 to the storing unit 126 of the banknote teller device 120 without removal of the release sheet 50. In this embodiment, if the release sheet detecting sensors 160 detect the release sheet 50 remaining on the storage bag 10 attached to the storing unit 126 of the banknote teller device 120, the display of the operation/display unit 129 notifies the operator of the results of detection. The means for notifying the operator is not limited to the display of the operation/display unit 129, and may be any one among various techniques such as the notification using voice and/or sound, for example.

In the storage bag 10 according to this embodiment, the release sheet 50 detachably adhering to the adhesive portion 40 to protect the adhesive portion 40 covers the second fixation tab 30 in the vicinity of the opening 14 of the body 12. This structure reminds the operator of the release sheet 50 upon the attachment of the second fixation tab 30 to the second holder 144 of the storage bag holder 140 for attaching the storage bag 10 to the storing unit 126 of the banknote teller device 120 and prompts the operator to remove the release sheet 50 surely from the adhesive portion 40.

In the storage bag 10 according to this embodiment, the release sheet 50 also detachably adheres to the inner surface of the body 12 in the vicinity of the second fixation tab 30 at the additional adhesive portion 42. This structure enables the operator to notice the adhesion between the release sheet 50 and the inner surface of the body 12 in the vicinity of the second fixation tab 30 and to notice the release sheet 50, upon the opening of the storage bag 10 to be attached to the storing unit 126 of the banknote teller device 120 and prompts the operator to remove the release sheet 50 surely from the adhesive portion 40.

In the storage bag 10 according to this embodiment, the first fixation tab 20 and the second fixation tab 30 respectively include the fixation ears 22 and 32 protruding upward from the edge of the opening 14 of the body 12. The first fixation tab 20 and the second fixation tab 30 respectively further include the through holes 24 and 34 for fixation.

In the storage bag 10 according to this embodiment, the release sheet 50 is bent to define the second sheet segment 54 that serves as a handgrip for an operator.

In the storage bag 10 according to this embodiment, the release sheet 50 has a color different from that of the body 12 and contains an opaque material. The release sheet 50 has a message described thereon that promotes an operator to remove the release sheet 50. These technical features can prompt the operator to remove the release sheet 50 surely from the adhesive portion 40 upon the attachment of the storage bag 10 to the storing unit 126 of the banknote teller device 120.

The storage bag 10 and the banknote teller device 120 are not limited to the above-described embodiments, and may be modified to a wide range of variations.

For example, a release sheet detachably adhering to the adhesive portion 40 to protect the adhesive portion 40 may cover the first fixation tab 20 instead of the second fixation tab 30. Such a modified embodiment will now be described with reference to FIG. 11. The components of the modified embodiment in FIG. 11 that are the same as those of the storage bag 10 in the drawings such as FIG. 7, will be referred to by the same reference signs without redundant description.

Figure 11:
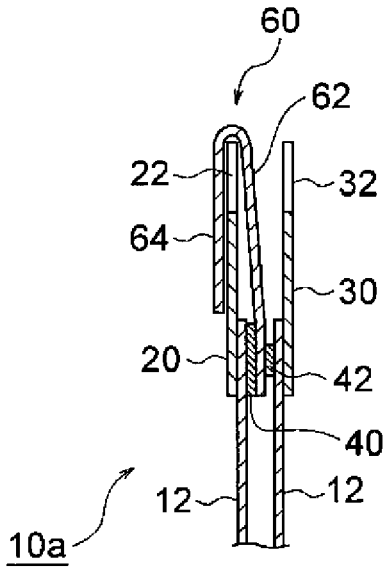
FIG. 11 is a longitudinal sectional view of a storage bag before removal of a release sheet according to a modified embodiment.

In a storage bag 10*a* according to the modified embodiment in FIG. 11, a release sheet 60 consists of a first segment 62 adhering to the adhesive portion 40 and a second folded segment 64 adjoining the first segment 62. The second segment 64 folded over the first segment 62 adhering to the adhesive portion 40 serves as a handgrip for an operator to remove the release sheet 60 from the adhesive portion 40. With reference to FIG. 11, the first segment 62 and the second segment 64 of the release sheet 60 cover the first fixation tab 20, in particular, the ears 22 of the first fixation tab 20. This structure reminds the operator of the release sheet 60 when the ears 22 of the first fixation tab 20 are placed such that the pins 143 of the first holder 142 stick through the though holes 24, and prompts the operator to remove the release sheet 60 surely from the adhesive portion 40, upon the attachment of the storage bag 10*a* to the storing unit 126 of the banknote teller device 120. In other words, the release sheet 60 must be removed to expose the through holes 24 of the ears 22 of the first fixation tab 20; hence, the pins 143 of the first holder 142 cannot stick through the through holes 24 without the removal of the release sheet 60. Thus, the release sheet 60 covering the first fixation tab 20 reminds the operator of removal of the release sheet 60 from the adhesive portion 40 upon the attachment of the storage bag 10*a* to the storing unit 126 of the banknote teller device 120 and prevents the operator from forgetting to remove the release sheet 60.

In another modified embodiment, a release sheet detachably adhering to the adhesive portion 40 to protect the adhesive portion 40 may cover both the first fixation tab 20 and the second fixation tab 30. Such a modified embodiment will now be described with reference to FIG. 12. The components of the modified embodiment in FIG. 12 that are the same as those of the storage bag 10 in the drawings such as FIG. 7, will be referred to by the same reference signs without redundant description.

Figure 12:
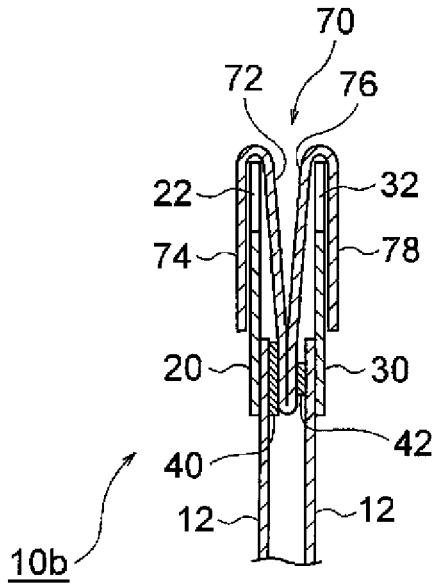
FIG. 12 is a longitudinal sectional view of a storage bag before removal of a release sheet according to another modified embodiment.

In a storage bag 10*b* according to the modified embodiment in FIG. 12, a release sheet 70 consists of a first sheet segment 72 adhering to the adhesive portion 40, a second folded sheet segment 74 adjoining the first sheet segment 72 to cover the first fixation tab 20, a third folded sheet segment 76 adjoining the first sheet segment 72 and detachably adhering to the inner surface of the body 12 in the vicinity of the second fixation tab 30 at the extremely-small additional adhesive portion 42, and a fourth folded sheet segment 78 adjoining the third sheet segment 76 to cover the second fixation tab 30. The second sheet segment 74 folded over the first sheet segment 72 adhering to the adhesive portion 40 serves as a handgrip for an operator to remove the release sheet 70 from the adhesive portion 40. With reference to FIG. 12, the first sheet segment 72 and the second sheet segment 74 of the release sheet 70 cover the first fixation tab 20, in particular, the ears 22 of the first fixation tab 20; whereas the third sheet segment 76 and the fourth sheet segment 78 of the release sheet 70 cover the second fixation tab 30, in particular, the ears 32 of the second fixation tab 30. Thus, the release sheet 70 covering both the first fixation tab 20 and the second fixation tab 30 reminds the operator of removal of the release sheet 70 from the adhesive portion 40 upon the attachment of the storage bag 10*b* to the storing unit 126 of the banknote teller device 120, preventing the operator from forgetting to remove the release sheet 70.

Although the above description illustrates the storage bag 10 including two fixation tabs, i.e., the first fixation tab 20 and the second fixation tab 30, the embodiments are not limited thereto. The storage bag 10 may include only one fixation tab, or may include three or more fixation tabs. In this invention, the release sheet 50 for the storage bag 10 including only one fixation tab covers this fixation tab.

In this invention, the storage bag 10 may include through holes for fixation at the upper body 12, instead of the fixation tabs such as the first fixation tab 20 and the second fixation tab 30. In this case, the storage bag 10 is attached to the storing unit 126 of the banknote teller device 120 such that the pins 143 and 145 each stick through each through hole for fixation at the upper body 12, and thus is opened and held with the first holder 142 and the second holder 144 of the storage bag holder 140. The through holes for fixation at the upper body 12 serve as fitting portions, and the release sheet 50 detachably adhering to the adhesive portion 40 to protect the adhesive portion 40 covers at least one of the through holes for fixation at the upper body 12.

For the banknote teller device 120 including the release sheet detecting sensors 160 for detecting the release sheet 50 remaining on the storage bag 10 held with the storage bag holder 140, the release sheet 50 does not necessarily need to cover the first fixation tab 20 and the second fixation tab 30 in the storage bag 10. Even for the release sheet 50 not covering the first fixation tab 20 or the second fixation tab 30, the release sheet detecting sensors 160 can detect the remaining release sheet 50 if an operator attaches the storage bag 10 to the storing unit 126 of the banknote teller device 120 without removal of the release sheet 50. In this case, if the release sheet detecting sensors 160 detect the release sheet 50 remaining on the storage bag 10 attached to the storing unit 126 of the banknote teller device 120, the display of the operation/display unit 129 notifies the operator of the results of detection. The release sheet detecting sensors 160, which detect the release sheet 50 remaining on the storage bag 10 attached to the storing unit 126, can remind the operator of removal of the release sheet 50 from the adhesive portion 40, preventing the operator from forgetting to remove the release sheet 50.

The release sheet detecting sensors 160 for detecting the release sheet 50 are not limited to optical sensors. The release sheet detecting sensors 160 may be magnetic sensors or other types of sensors, and the release sheet 50 may be provided with a material such as metal detectable by the magnetic sensors.

Although the above description illustrates the storage bag 10 detachably attached to the banknote teller device 120 provided in the backyard area, the embodiments are not limited thereto. For example, the storage bag 10 may be detachably attached to a cash checkout machine provided in the front area.

The banknote teller device 120, which includes the release sheet detecting sensors 160 in the storing unit 126 for detecting the release sheet 50 remaining on the storage bag 10 attached to the storing unit 126, may transmit information on the detection of the release sheet 50 by the release sheet detecting sensors 160 to a master terminal or mobile terminal to notify a store manager or security company of the information, in addition to or instead of the notification by notification means such as the operation/display unit 129.

The invention claimed is:

1. A paper sheet storing device, comprising:

a storing unit to which a storage bag for storing the paper sheet is detachably attached, a transport unit configured to transport the paper sheet to the storage bag attached to the storing unit, and a storage bag holder configured to hold the storage bag attached to the storing unit in such a manner that the storage bag is opened; wherein the storage bag includes a body having a top opening, a fitting portion disposed in the vicinity of the opening of the body, the fitting portion being adapted to be fixed to the storage bag holder, an adhesive portion disposed on an inner surface of the body in the vicinity of the opening, the adhesive portion being configured to seal the body, and a release sheet detachably adhering to the adhesive portion, the release sheet protecting the adhesive portion, and the fitting portion is not exposed to the outside unless the release sheet is removed from the adhesive portion.

2. The paper sheet storing device according to claim 1, wherein the fitting portion of the storage bag includes a first fitting portion and a second fitting portion disposed in the vicinity of the opening of the body, the adhesive portion is disposed on an inner surface of the body in the vicinity of the first fitting portion, and the release sheet covers at least one of the first fitting portion and the second fitting portion.

3. The paper sheet storing device according to claim 2, wherein the release sheet also detachably adheres to another inner surface of the body in the vicinity of the second fitting portion.

4. The paper sheet storing device according to claim 1, wherein the release sheet of the storage bag includes a first sheet segment adhering to the adhesive portion and a second sheet segment adjoining the first sheet segment via the fold, and the release sheet covers the fitting portion such that the fitting portion is sandwiched between the first sheet segment and the second sheet segment.

5. The paper sheet storing device according to claim 1, wherein there is no release sheet holder for holding the release sheet.

6. A paper sheet storing method, comprising:

preparing a storage bag including a body having a top opening, a fitting portion disposed in the vicinity of the opening of the body, the fitting portion being adapted to be fixed to a storage bag holder, an adhesive portion disposed on an inner surface of the body in the vicinity of the opening, the adhesive portion being configured to seal the body, and a release sheet detachably adhering to the adhesive portion, the release sheet protecting the adhesive portion, exposing the fitting portion and the adhesive portion to the outside by detaching the release sheet from the adhesive portion, holding the storage bag by the storage bag holder in such a manner that the storage bag is opened by fixing the fitting portion of the storage bag to the storage bag holder, storing the paper sheet in the opened storage bag held by the storage bag holder, and sealing the body by the adhesive portion.

7. The paper sheet storing method according to claim 6, wherein the fitting portion of the prepared storage bag includes a first fitting portion and a second fitting portion disposed in the vicinity of the opening of the body, the adhesive portion is disposed on an inner surface of the body in the vicinity of the first fitting portion, and the release sheet covers at least one of the first fitting portion and the second fitting portion.

8. The paper sheet storing method according to claim 7, wherein the release sheet also detachably adheres to another inner surface of the body in the vicinity of the second fitting portion.

9. The paper sheet storing method according to claim 6, wherein the release sheet of the prepared storage bag includes a first sheet segment adhering to the adhesive portion and a second sheet segment adjoining the first sheet segment via the fold, and the release sheet covers the fitting portion such that the fitting portion is sandwiched between the first sheet segment and the second sheet segment.

10. A storage bag for storing a paper sheet used in a paper sheet storing device including a storing unit to which the storage bag is detachably attached, a transport unit configured to transport the paper sheet to the storage bag attached to the storing unit, and a storage bag holder configured to hold the storage bag attached to the storing unit in such a manner that the storage bag is opened, comprising:

a body having a top opening, a fitting portion disposed in the vicinity of the opening of the body, the fitting portion being adapted to be fixed to the storage bag holder, an adhesive portion disposed on an inner surface of the body in the vicinity of the opening, the adhesive portion being configured to seal the body, and a release sheet detachably adhering to the adhesive portion, the release sheet protecting the adhesive portion; wherein the fitting portion is not exposed to the outside unless the release sheet is removed from the adhesive portion.

11. The storage bag according to claim 10, wherein the fitting portion of the storage bag includes a first fitting portion and a second fitting portion disposed in the vicinity of the opening of the body, the adhesive portion is disposed on an inner surface of the body in the vicinity of the first fitting portion, and the release sheet covers at least one of the first fitting portion and the second fitting portion.

12. The storage bag according to claim 11, wherein the release sheet also detachably adheres to another inner surface of the body in the vicinity of the second fitting portion.

13. The storage bag according to claim 10, wherein the release sheet of the storage bag includes a first sheet segment adhering to the adhesive portion and a second sheet segment adjoining the first sheet segment via the fold, and the release sheet covers the fitting portion such that the fitting portion is sandwiched between the first sheet segment and the second sheet segment.

14. The paper sheet storing device according to claim 1, wherein a pin is provided with the storage bag holder, a through hole for fitting, through which the pin sticks, is provided with the fitting portion, the release sheet includes a first sheet segment adhering to the adhesive portion and a second sheet segment adjoining the first sheet segment via the fold, the release sheet covers the fitting portion such that the through hole of fitting portion is sandwiched between the first sheet segment and the second sheet segment, and the through hole is not exposed to the outside unless the release sheet is removed from the adhesive portion.

15. The storage bag according to claim 10, wherein a pin is provided with the storage bag holder, a through hole for fitting, through which the pin sticks, is provided with the fitting portion, the release sheet includes a first sheet segment adhering to the adhesive portion and a second sheet segment adjoining the first sheet segment via the fold, the release sheet covers the fitting portion such that the through hole of fitting portion is sandwiched between the first sheet segment and the second sheet segment, and the through hole is not exposed to the outside unless the release sheet is removed from the adhesive portion.

* * * * *